United States Patent [19]

McFee

[11] 3,970,302

[45] July 20, 1976

[54] EXERCISE STAIR DEVICE

[76] Inventor: Richard McFee, 852 Ostrom Ave., Syracuse, N.Y. 13210

[22] Filed: Jan. 8, 1975

[21] Appl. No.: 539,585

Related U.S. Application Data

[63] Continuation-in-part of Ser. No. 483,539, June 27, 1974, abandoned.

[52] U.S. Cl. ..... 272/130

[51] Int. Cl.[2] ..... A63B 21/00; A63B 23/04

[58] Field of Search ..... 272/79 R, 79 C, 69, 272/81, 82, 83

[56] References Cited

UNITED STATES PATENTS

| | | | |
|---|---|---|---|
| 1,521,487 | 12/1924 | Turner | 272/83 R UX |
| 2,253,996 | 8/1941 | Bechman | 272/79 R UX |
| 3,495,824 | 2/1970 | Cuinier | 272/79 C X |
| 3,511,500 | 5/1970 | Dunn | 272/79 R |
| 3,529,474 | 9/1970 | Olson et al. | 272/79 C |
| 3,582,069 | 6/1971 | Flick et al. | 272/79 R |
| 3,587,319 | 6/1971 | Andrews | 272/79 C X |
| 3,628,791 | 12/1971 | Garcia | 272/69 X |
| 3,747,924 | 7/1973 | Champoux | 272/79 R |
| 3,756,595 | 9/1973 | Hague | 272/79 C X |
| 3,758,112 | 9/1973 | Crom et al. | 272/79 C |

*Primary Examiner*—Paul E. Shapiro
*Attorney, Agent, or Firm*—Kenyon & Kenyon Reilly Carr & Chapin

[57] ABSTRACT

The exercise stair device is a lightweight compact unit which simulates the exercise obtained while climbing stairs.

In one form, two small carriages providing foot supports move on adjacent tracks which are about three feet long and inclined at an angle of about 35° with the horizontal. The carriages are connected to one another so that when one moves up, the other moves down and vice versa. The rate of exercise is determined by the rate at which the carriages descend. The apparatus includes means for providing a resistance (counterforce) to motion of the foot supports which increase with velocity. Under the full weight of the user the steps descend at a uniform rate determined by his weight. This resistance means dissipates the energy transmitted thereto in the process.

In a second form, the exercise device has two pivotally mounted arms which carry foot supports. These arms are interconnected so that as one pivots upwardly, the other pivots downwardly. Similar energy dissipating means are connected to the arms to dissipate the energy imposed on the arms during use.

13 Claims, 7 Drawing Figures

EXERCISE STAIR DEVICE

This is a continuation-in-part of my U.S. patent application Ser. No. 483,539 filed June 27, 1974 now abandoned.

This invention relates to an exercise stair device for simulating a climbing activity. More particularly, this invention is directed to an exercise device for obtaining vigorous exercise in the home, gym and clinic.

Medical research has shown that regular vigorous exercise helps to keep the body in good tone, reduces back problems and decreases the incidence of heart disease by a substantial factor. Since heart disease causes a substantial number of deaths, regular exercise may well increase longevity significantly.

Common means of obtaining vigorous exercise are swimming, basketball and tennis. However, many people find that these forms of exercise are difficult to obtain because expensive, often crowded and distant facilities are usually required. Jogging is another common form of exercise but this requires either an indoor track or exposure to traffic and inclement weather conditions. In addition, jogging imposes a stress on the joints of the body, particularly when jogging on pavement or other hard surfaces.

Because of these difficulties, various types of exercise devices for obtaining vigorous exercise in the home have been developed. Among these are the rowing machine, the stationary exercise bicycle which is sometimes motorized and the endless belt walker. However, all of these devices have disadvantages. For example, since rowing in unnatural in requiring the use of unusual muscles and being particularly hard on the back, rowing machines cannot generally be used for more than five minutes or so by most people. The same applies to the exercise bicycle. In the case of the endless belt walkers, such generally have relatively small inclines so that the exercise obtained has not really been vigorous. In addition, where these walkers have used rollers under the endless belts, an uncomfortable feel has been imposed on the feet of the user.

In addition to the above disadvantages, the rate of exercise with respect to these various devices has generally not been easily metered. Such metering is essential if the exercise is part of a medical program or medical testing or if metering is desired for any sensible exercise program.

Up to the present time, the superior form of device available for obtaining precisely metered exercise in a natural manner has been the motorized inclined tread mill. Such a device has been used in many medical laboratories in order to investigate the effects of exercise. Generally, by adjusting the speed and incline of the device, the amount of exercise can be precisely controlled. However, such tread mills are usually not found in most homes because the machines are relatively expensive, bulky and noisy. For example, these tread mills may well cost over $1500, weigh a ton or so and make an unpleasant scraping noise as an endless belt of the tread mill moves over a steel surface beneath the belt. Generally, when these tread mills have been set to a steep incline, the foot, of the user must be sharply angled in an uncomfortable way.

Accordingly, it is an object of the invention to provide an inexpensive, lightweight, compact and quiet exercise stair device.

It is another object of the invention to provide a device for obtaining a precisely metered vigorous exercise without shock to the body joints.

It is another object of the invention to provide a stair exercise device which does not require sharp angling of a user's foot during use.

It is another object of the invention to provide an exercise device which does not require an electric motor to operate.

It is another object of the invention to provide an exercise stair device which can be readily adjusted to accommodate different exercise forces.

Briefly, the invention provides an exercise stair device which simulates the exercise obtained while climbing stairs. The device comprises two foot supports each of which is movable in a reciprocating manner, a means for guiding each of the foot supports along adjacent paths having vertical components, a means for coupling the foot supports together to move in opposite directions in these paths and a means for causing the foot supports to descend at a uniform velocity under the full weight of the user and for dissipating the energy released during use of the device by a simulated climbing activity of the user obtaining a uniform velocity of the foot supports which is called for earlier by providing a resistance counterforce to motion that increases substantially as velocity is increased.

In one embodiment, the exercise device comprises a frame having a pair of inclined tracks for guiding each of the foot supports up and down. The foot supports, in turn, are each rollably or slidably mounted on a respective one of the tracks. In this embodiment, the foot supports are embodied by two small carriages and the tracks are about three feet long and are inclined at an angle of about 35° with the horizontal. The foot supports are coupled together by a suitable means to move in opposite directions on the tracks. In addition, each foot support has a platform which is more or less level, i.e. horizontal, on which a user steps during use.

In order to couple the foot supports together, use may be made of a cable means or a chain connected at respective ends to the two supports. One or more pulleys may also be used to guide the cable means or chain. In addition, the means for dissipating the energy of the device may be connected to the foot supports or the cable means or chain. In order to reduce the movement of the resistance or energy dissipating means, use may be made of a pivotally mounted lever which is connected to the cable means or chain and at an intermediate point to the energy dissipating means. The dissipating means may thus be in the form of a shock absorber which is connected to the lever.

In another embodiment, the exercise stair device includes a pair of pivotally mounted arms each of which has a foot support mounted on a free end and each of which is pivotable in a vertical plane so that the foot supports may move with an up and down motion. In this embodiment, the foot supports may be in the form of pedals or non-rotating platforms. In the latter case, in order to maintain the platforms horizontal, a tension arm is placed in parallel with each support arm and is pivotally mounted at opposite ends to the support arm by vertical struts. In addition, the foot support is secured to the outermost vertical strut.

In order to couple the foot supports together via the arms, a gear assembly may be secured to the pivot end of the arms. Also, a pulley and chain assembly may be used between the arms.

In each of the above embodiments, the exercise stair device is incorporated in a frame in a relatively compact manner. The frame may also include an upstanding handhold in the form of side rails or a horizontal cross bar to provide a grip for the user.

In use, the user steps on one foot support while removing his weight from the other. The foot support then descends at a rate determined by the resistance or energy dissipation means which hinders the movement of the support. When the support reaches the end of the track, or shortly before, the user transfers his weight to the other foot support and the motion of both supports reverses. For example, when the counterforce required by the weight of the user is produced at low velocity, the descent is slow and the rate of exercise is slow. When a high velocity is required to produce this force, the descent is fast and the rate of exercise high.

The foot supports are caused to descend at a uniform velocity through the use of the energy dissipation means which provides a resistance counterforce to motion that increases substantially as velocity is increased. An example of such a means is the hydraulic shock absorber wherein a counterforce varies more or less linearly with velocity, i.e. doubles when velocity doubles. When the user places his full weight on a foot support connected to such a shock absorber, the support will descend at a speed proportional to his weight.

In place of a shock absorber, use may be made of a rotary actuator or a pump having two input-output orifices connected together by a small bore-tube. If means such as a throttle is provided for adjusting the size of a constriction placed in the path of the oil flow (valve), control of speed of descent is achieved and allowance may be made for differences in weight among users.

Another type of energy dissipation or resistance means is an electric generator connected to a resistor.

Many resistance devices are, however, unsuitable for use. Two examples are the two types of brakes found in automobiles, the shoe and the disk brakes. With these, a relatively high force is required for motion to commence (static friction). After motion has started, the kinetic resistance force reduces to three-quarters or one-half of the static value and remains more or less constant regardless of velocity (at a fixed pressure on the shoe or disk pads). With an exercise stair, this characteristic would have the following result. When the user transferred his full weight to a foot support, the foot support would remain fixed if the static friction were greater than his weight, or would plunge abruptly to the floor were his weight to overcome the static resistance and the resistance force thereafter to decrease to the lesser kinetic friction value. However, it might be possible to use disk or shoe brakes in exercise stairs if provided with special mechanisms designed to increase shoe or pad pressure with velocity.

An inexpensive and practical type of resistance means is the piston type of automotive shock absorber. In this device a piston moves in a closed cylindrical tube. During movement the piston forces oil from the region on one side of the piston to that on the other through a small opening. In general, the relation between resistance force and velocity is not the same for both directions of motion. This asymmetry is oten incorporated deliberately into the design of the shock absorber by various means. A natural asymmetry also exists. The piston must be connected to the outside, and this is done by means of a rod. This rod is attached to one side of the piston and exits from the oil chamber via a seal. The area of the piston on which the oil pressure acts is reduced on one side by the area of this rod. This can cause an asymmetry in the force-velocity relationship. Such asymmetries cannot be tolerated in exercise stairs, for if they existed the right step would descend faster than the left or vice versa. The asymmetry can be avoided through the use of two shock absorbers arranged in "push-pull", that is, one shortens while the other lengthens. With this arrangement, the total resistance force will not depend on the direction of movement.

Whatever means is used to obtain the resistance force, heat dissipation is a problem. A person who weighs 150 pounds and who is climbing at a rate of 1 foot per second will deliver an energy of 150 foot-pounds/sec to the exercise stair, that is, 200 watts. A 225 pound football player, climbing at a rate of 2 feet/-second, would deliver 600 watts to the exercise stair. The cooling provided by a cylinder of one or two inches diameter in free air is known to be about 0.004 watt-s/in$^2$ per °F if the temperature of the cylinder is of the order of 100°F above ambient. Thus, two shocks, each 1 ½ inches in diameter and 8 inches long operating at a temperature 80°F above ambient will dissipate roughly 25 watts in free air. Free air cooling is thus not adequate for such shocks when they are used in exercise stairs. Fortunately, many automotive shocks are provided with dust covers. As the shock shortens and lengthens, these covers suck air in and blow the air out over the body of the shock, thus providing forced air cooling. When a 185 pound person climbed an exercise stair at a rate of 1 foot per second for a period of ½ hour, the surface temperature rise over ambient of the two shocks used, each with a dust cover, (each 1 ½ inch diameter and 8 inches in length) was found to be 80°F. When exercise stairs are to be used by heavy persons capable of climbing at high rates over periods of 10 minutes or more, a "heavy duty" unit employing four shocks rather than two would be appropriate.

Rotary actuators do not have dust covers and thus call for a radiator. There are many ways to cause the motion of the carriages of the exercise stair, or the rotation of the actuator, to fan air through such a radiator.

Automotive piston type shocks are intended to be operated in a more or less upright position. The shocks employed in the preferred embodiment perform well at an angle of 50° from the vertical. However, it was found that some shocks suffer a drastic loss of resistance after extended operation at this inclination.

When the user's full weight is placed on one platform of a foot support or the other, the effective distance climbed is equal to the total downward movement of the foot support. For example, for a maximum downward motion of 10 inches and with a stepping rate of about six steps in 5 seconds, the effective distance of climb is one foot per second. That is, the effective climbing rate is 60 feet per minute or 3600 feet per hour. Thus, with the exercise device, one can simulate a climb from sea level to the top of Mount Everest (30,000 feet) in about 8 and ½ hours.

So long as all of one's weight is either on one platform or the other, the rate of descent of the platform is constant due to the resistance offered by the energy dissipation means. Thus, one can take fast short steps or long slow ones without altering the climbing rate. The amount of climb is directly proportional to time.

By allowing a platform to transverse from one extreme to the other and determining the vertical rise R associated with this (10 inches in the above mentioned example) and noting the associate number N of steps per minute, the total climb and feet is given by the formula:

$$\text{Climb} = KT$$

wherein $T$ is time and $K$ is RN.

A suitable means for measuring and displaying the total effective climb or the effective climbing rate may be provided. For example, in the pedal type embodiment, a gear may be connected to an arm at the pivot and an electrical contact may be placed in between the teeth of the gear so that intermittent contact is made when the gear rotates. In this way, an electrical impulse may be produced each time a platform travels a predetermined distance, for example, 0.1 feet. A count of these impulses can then be displayed in any one of a large variety of ways well known in the electronic art, for example, through the use of a minature electronic counter Type 767 E manufactured by Conrac Corporation.

These and other objects and advantages of the invention will become more apparent from the following detailed description and appended claims taken in conjunction with the accompanying drawings in which:

Figure 1:
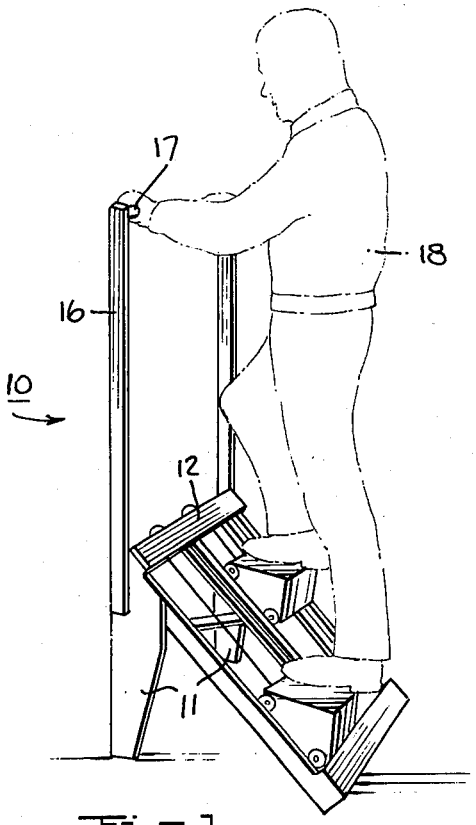
FIG. 1 illustrates a perspective view of an exercise stair device in use.
Figure 2:
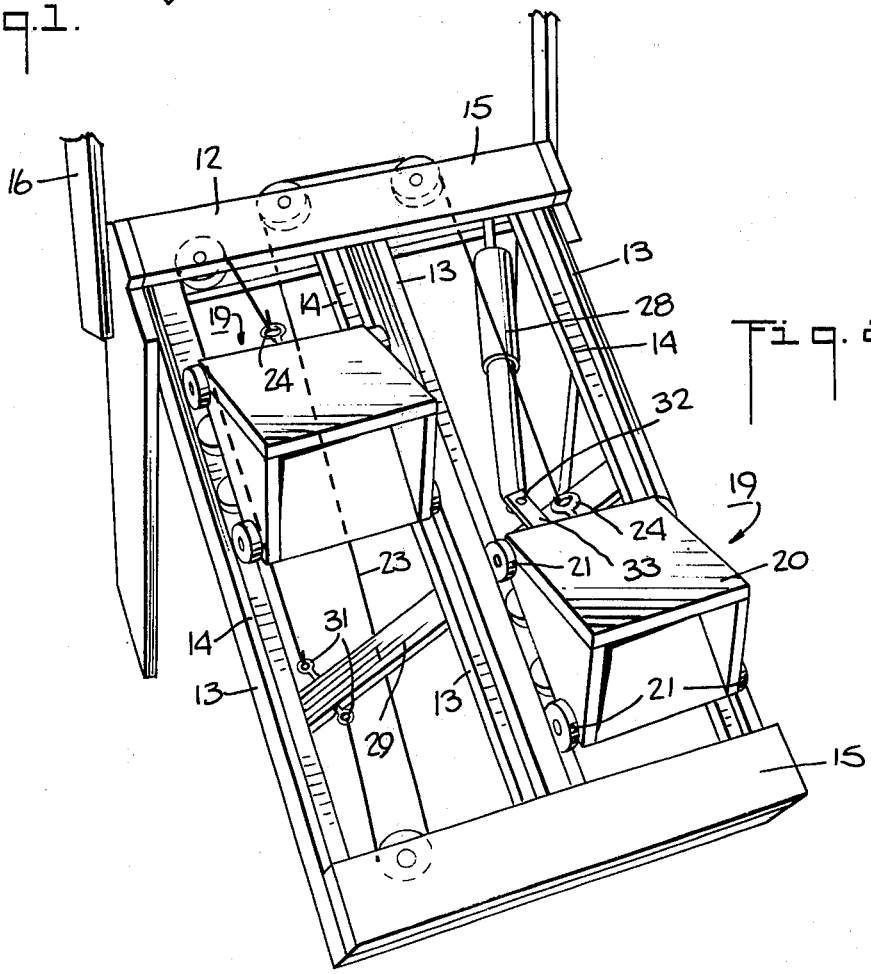
FIG. 2 illustrates a perspective view of the foot supports on the frame of the exercise device of FIG. 1.

Referring to FIG. 1, the exercise device 10 which is of the carriage type is constructed in a relatively compact manner so as to be stored in a closet. The device 10 has a frame made up of a pair of vertical legs 11 and a rectangular skeletal frame 12. The skeletal frame 12 is about three feet long and has two pairs of inclined tracks 13 which are about two and one-half feet long and are inclined at an angle of about 35° with the horizontal. As shown in FIG. 2, each track 13 defines an L-shaped channel 14. The skeletal frame 12 also has cross-bars 15 extending across the top and bottom at the terminal points of the track 13. In addition, the device 10 has an upstanding handhold 16 secured to the legs 11. This handhold 16 includes a horizontal cross-bar 17 for gripping by a user 18.

Referring to FIG. 2, the exercise device 10 includes a pair of foot supports 19 or carriages each of which has a platform 20 disposed in a horizontal plane or an approximately horizontal plane. Each platform 20 is, for example 10 inches long and 8 inches wide. In addition, each support 19 is rollably mounted by a plurality of wheels 21 in a respective pair of tracks 13 and may carry a means in the form of pairs of wheels 22 on the side for guiding the support 19 horizontally within the channels 14 of the tracks 13.

Figure 3:
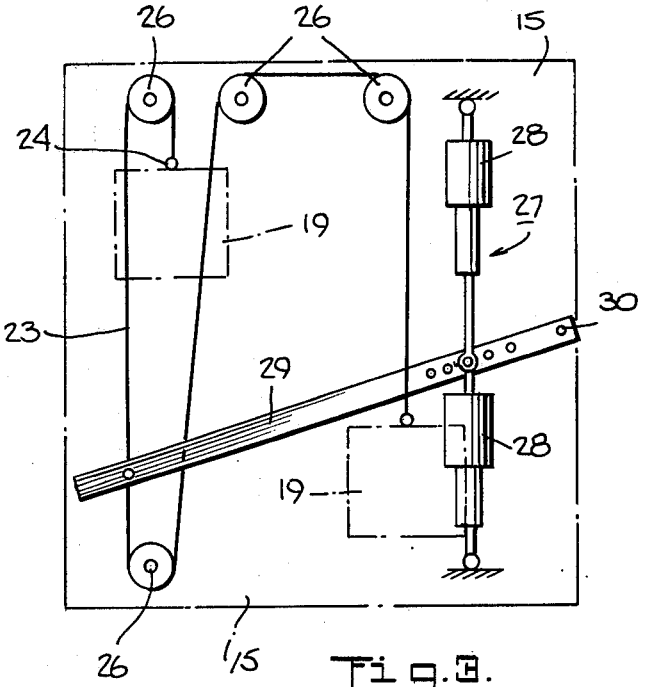
FIG. 3 illustrates a schematic view of the interconnection between the foot supports, coupling means and energy dissipation means according to the invention.

Referring to FIGS. 2 and 3, a coupling means 23 is provided to couple the foot supports 19 together to move in opposite directions in the respective paths defined by the tracks 13. This coupling means 23 includes a cable which is connected at opposite ends to the respective foot supports 19. As shown, each end of the cable 23 is secured about an eyelet 24 which is threadably mounted in a foot support 19. In addition, the coupling means includes a plurality of pulleys 26 (e.g. four) which are fixedly mounted in the frame 12 on the horizontal cross bars 15. The cable 23 passes about each pulley 26 to be guided thereby so that as one support 19 moves up, the other support 19 moves down, and vice versa. An additional length of cable (not shown) may also be connected at opposite ends to the rear of each foot support 19 to retain the foot supports 19 on the frame 12 at all times. Such a cable may also pass about one or more pulleys (not shown) mounted on the lower cross bar 15. The cable 23 is of high quality, e.g. ⅛ inch aircraft type 2000 pound test to absorb repeated strain. To avoid sharp bending which may tend to fray the cable, the pulleys 26 should have a minimum diameter of three inches.

Referring to FIG. 3, the exercise device 10 also includes means 27 for causing the foot supports 19 to descend at constant velocity under the weight of the user and for dissipating the energy transmitted to the foot supports 19. This means 27 includes a pair of shock absorbers 28, such as a Sears No. 7877, each of which is pivotally mounted at one end on a cross bar 15 of the skeletal frame 12 and at the other end to a lever 29. The lever 29, in turn, is pivotally mounted at one end on a pin 30 secured in the skeletal frame 12 at the side of a track 13 and at the opposite end to an intermediate point of the cable 23. As shown in FIG. 2, the lever 29 has a pair of eyelets 31 threadably mounted thereon to anchor the cable 23 to the lever 29; the cable 23 in this case being formed of two pieces. Any other suitable means may, however, be used to secure the lever 29 to the cable 23. Each shock absorber 28 is pivotally secured via a pin 32 to a plate 33 mounted on the lever 29. Alternatively, as shown in FIG. 3, each shock absorber 28 may be secured directly to the lever 29.

The shock absorbers 28 are attached to the lever 29 at a point approximately 30% as far from the pivot pin 30 as is the point where the cable 23 is attached. Thus, for example, when the cable moves 18 inches, the shock absorbers 28 each move 5.4 inches.

In use, as shown in FIG. 1, the user 18 steps on one foot support 19 to move the support 19 downwardly to a lower end of the track 14. During this time, the other support 19 is moved upwardly. Thereafter, the user steps on the raised foot support 19 which has reached an upper end of its respective track 14 to move this support downwardly while the other support 19 is raised. This type of motion continues over a period of time. During movement of the foot supports 19, the lever 29 pivots against the force of the shock absorbers 28. With this arrangement, one shock shortens while the other lengthens so that the net force exerted by the shocks on the lever is the same regardless of the direction of motion of the lever.

In order to adjust the rate of the climb, the distance between the pivot point of the lever 29 and the point of attachment of the shocks 28 may be altered. The smaller the distance, the faster the foot support moves and the harder the exercise. Also, in order to vary the rate of climb, the angle of the track 13 to the horizontal may be varied, e.g. by changing the length of the legs 11.

It is to be noted that one shock absorber may be used instead of two shock absorbers if, this shock is designed to have the same resistance to motion at a given velocity regardlss of the direction of motion. In the case of multiple shocks, the increased surface area provides a better cooling effect.

Also, instead of using the lever 29, one or more shock absorbers may be secured directly to a foot support. For example, use may be made of a shock especially designed to have a symmetrical force-velocity characteristic and to be capable of a travel equal to that of the foot supports 19, e.g. 18 inches. This permits connection of the shock to the foot support 19. This shock may be designed with a valve so as to have an adjustable resistance so that easy control of the rate of exercise is possible. Further, the large surface area of this unusually long shock absorber would, with a dust cover, promote good cooling, thus preventing an excessive temperature rise in the shock oil.

Figure 4:
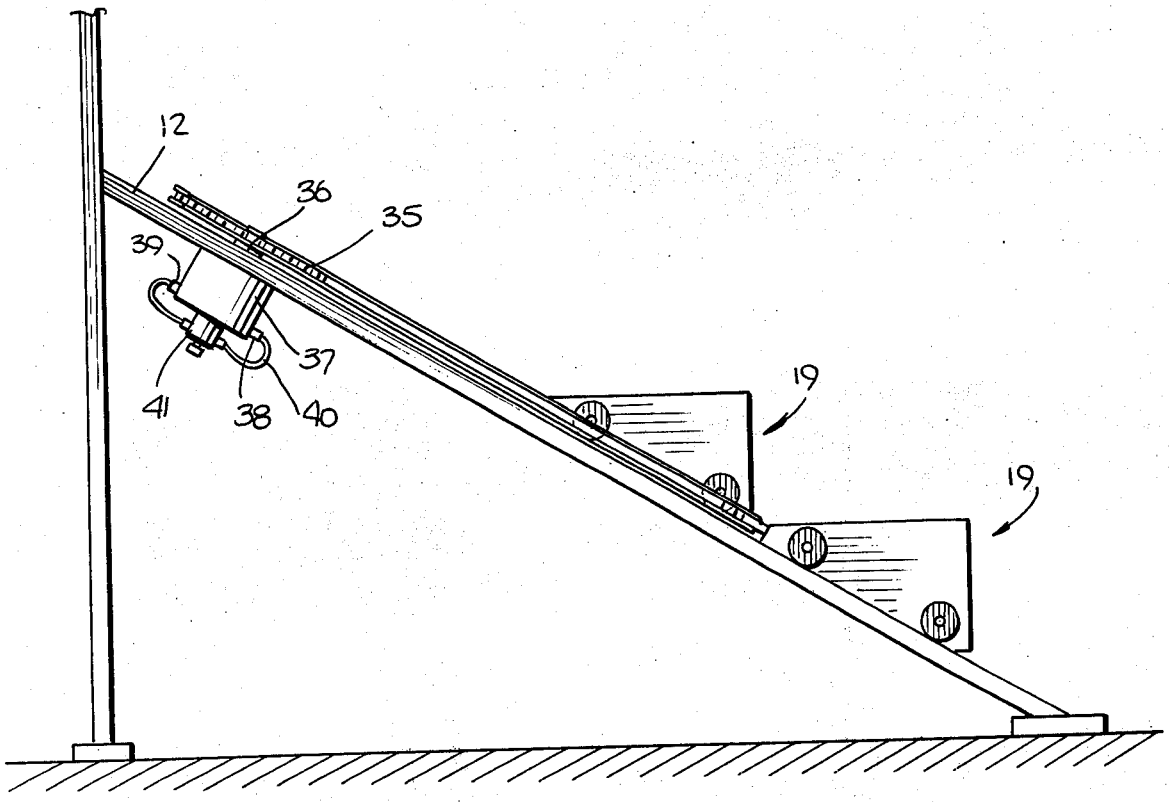
FIG. 4 illustrates a modified embodiment of the exercise stair device according to the invention.
Figure 5:
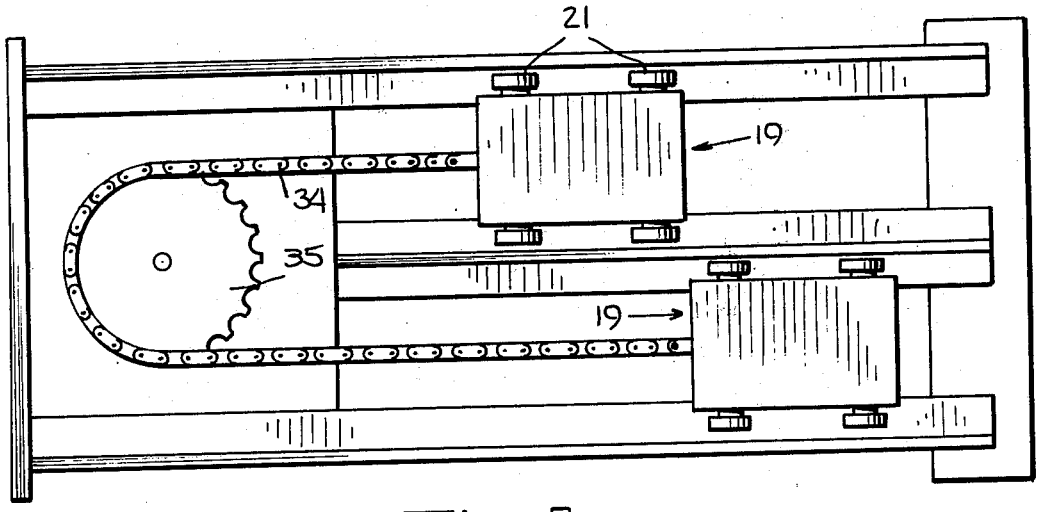
FIG. 5 illustrates a plan view of the exercise device of FIG. 4.

Referring to FIGS. 4 and 5, wherein like reference characters indicate like parts as above, the exercise device may alternatively be constructed in a simplified manner. To this end, the means for coupling the foot supports 19 together consists of a chain 34 which is secured at the ends of the respective foot supports 19 and a sprocket 35 about which the chain 34 passes. As shown in FIG. 4, the sprocket 35 which is about 9 inches in diameter is mounted for rotation on a shaft 36 rotatably secured in the upper cross bar 15 of the frame 12. In addition, the resistance means connected to the foot supports 19 includes a rotary actuator 37 connected to the sprocket shaft 36 for rotating in the same direction as the sprocket 35. The rotary actuator 37 has an output orifice 38, another such orifice 39 and a tube 40 connecting the orifice 38 to the orifice 39. In addition, a suitable means such as a throttling means 41 is interposed in the tube 40 for adjusting the size of the tube bore.

When the rotary actuator 37 is in operation, the fluid pressure at the output orifice 38, for example, is higher than that at the input orifice 39. The reverse is true when rotation is in the opposite direction. In this case, the rotary actuator 37 is used as a pump.

When the user steps on one foot support 19, the chain 34 and hence the sprocket 35 start to move so that the vane (not shown) in the actuator 37 causes a higher pressure to appear at one orifice than at the other. Fluid then flows out of the orifice into the other orifice with the rate of flow being determined by the narrowness of the constriction in the tube 30 connecting the two orifices 38, 39.

Because rotary actuators lack the dust covers needed to provide forced air cooling, the oil of the actuator is passed through a small radiator (s) (not shown) through which air is forced.

Figure 6:
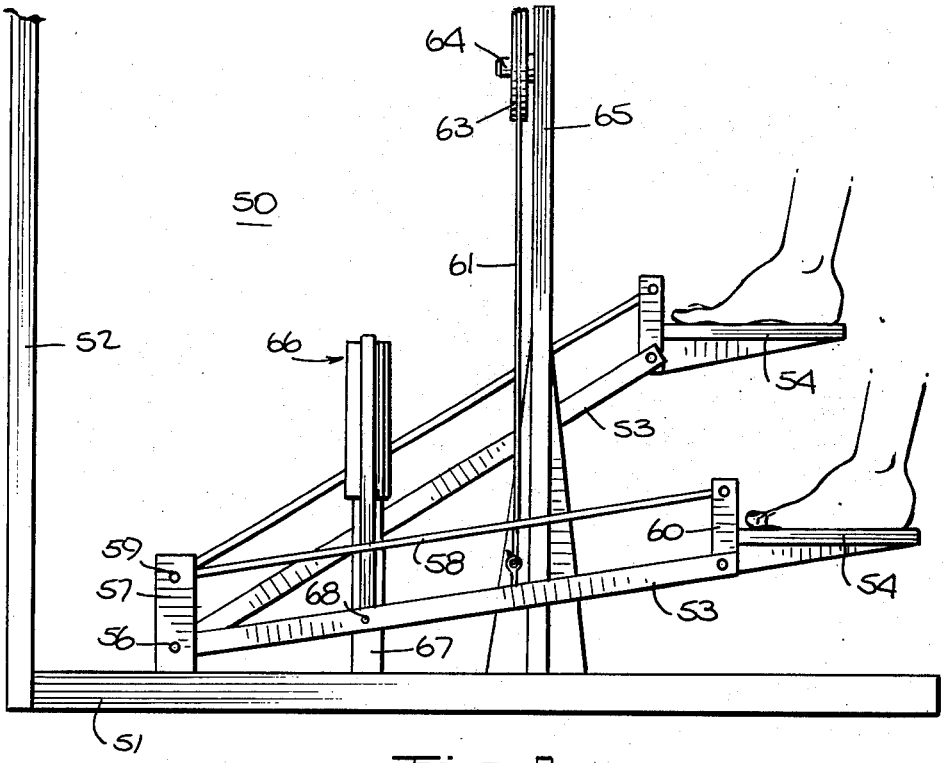
FIG. 6 illustrates a further modification of an exercise stair device according to the invention.
Figure 7:
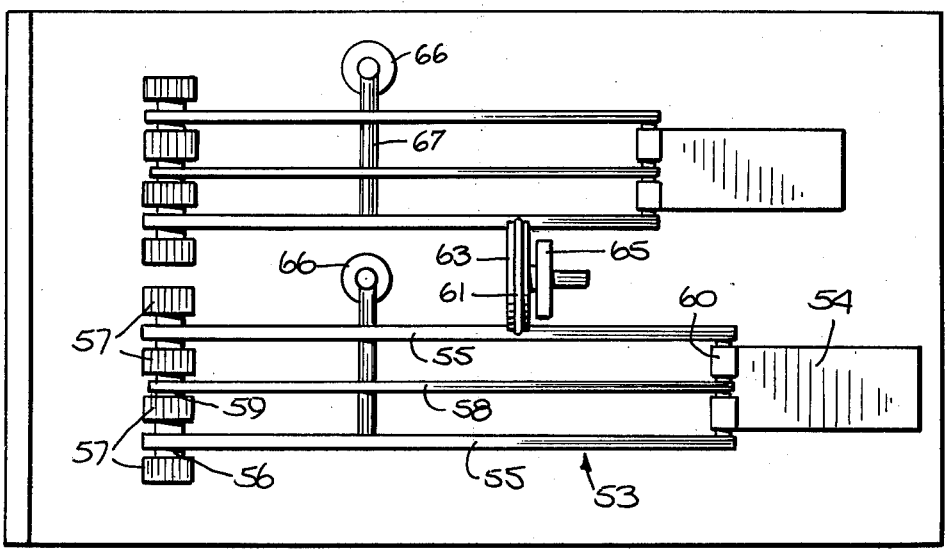
FIG. 7 illustrates a plan view of the exercise device of FIG. 6.

Referring to FIGS. 6 and 7, the exercise stair device may be embodied in a further modification. As shown, the exercise device 50 includes a support frame 51 and an upstanding handhold frame 52 similar to that described above. In addition, a pair of arms 53 are pivotally mounted on the support frame 51 in parallel and each carries a foot support 54 at a free end. As shown in FIG. 7, each arm 53 is constructed of a pair of main bars 55 which are pivotally mounted on a common pivot shaft 56 passing through a pair of upstanding struts 57. In addition, a tension arm 58 is pivotally mounted about a pin 59 secured in the struts 57 and is disposed in parallel to the bars 55. A vertical strut 60 is pivotally secured at the free ends of tension arm 58 and the two main bars 55 to effect a parallelogram. In addition, the foot support 54 is secured to the vertical strut 60 so as to be maintained in a level horizontal plane during vertical pivoting motion of the arm 53.

The two arms 53 are interconnected by a cable 61 which is anchored at the respective ends to eyelets 62 in each of the arms 63. In addition, the cable 61 passes about a suitable pulley 63 which is mounted on a shaft 64 secured in an upstanding support 65 on the support frame 51.

Shock absorbers 55 are pivotally mounted in dependent manner from an upstanding support 67 secured to the support frame 51. Ech shock absorber 66 is also pivotally connected at the support end via a pin 68 to one of the arms 53, i.e. to the main bars 55 so as to restrain vertical motions of the arm 53. As shown, two shock absorbers 66 are used to dampen the motion of the pivoting arms 53 although one may be used provided the shock has a symmetrical force versus velocity characteristic.

The operation of the exercise device 50 is similar to that described above and need not be further described.

Other embodiments of the invention are also possible. For example, in an embodiment similar to that shown in FIGS. 4 and 5, instead of using a rotary actuator, a second sprocket of smaller diameter than sprocket 35 may be connected to the sprocket shaft 36 with an endless chain passed about the sprocket and a suitable idler sprocket. In addition, one or more friction devices may be connected to the respective reaches of the endless chain as the energy dissipating means. These sprockets, chain and friction devices may be located on the underside of the frame 12.

The invention thus provides an exercise device which is able to simulate the climbing of steps in a relatively easy compact manner. The device can be made of any suitable materials so as to be lightweight, inexpensive and compact. For example, the handhold frame may be pivotal with respect to the remainder of the device or made of telescoping tubes so as to be collapsed for storage. The legs of the embodiment of FIGS. 1 to 3 may also be pivotal relative to the inclined tracks for similar purposes. Similarly, the support base and upstanding supports of the other embodiments may be collapsible for storage purposes.

In addition, the invention provides an exercise device in which the sources of noise are sharply localized and which can be easily muffled.

What is claimed is:

1. An exercise stair device comprising two foot supports, each said support being movable in a reciprocating manner, first means for guiding each of said foot supports along adjacent paths having vertical components, said first means including a pair of inclined tracks each said track having a respective one of said foot supports movably mounted thereon, second means for coupling said foot supports together to move in opposite directions in said respective paths, and third means for causing said foot supports to descend at constant velocity under the weight of a user and for dissipating energy transmitted to said foot supports during use of the device by a simulated climbing activity of the user.

2. An exercise stair device as set forth in claim 1 wherein said second means includes a plurality of fixedly mounted pulleys and a cable disposed about said pulleys and connected to said foot supports.

3. An exercise stair device as set forth in claim 1 which further comprises a frame having said foot supports and each said means mounted thereon and an upstanding handhold secured to said frame.

4. An exercise stair device as set forth in claim 1 which further comprises means for adjusting the rate of descent of said foot supports.

5. An exercise stair device comprising two foot supports, each said support being movable in a reciprocating manner, first means for guiding each of said foot supports along adjacent paths having vertical components, said first means including a pair of inclined tracks, each said track having a respective one of said foot supports movably mounted thereon, second means for coupling said foot supports together to move in opposite directions in said respective paths, and third means for dissipating energy transmitted to said foot supports during use of the device by a simulated climbing activity of the user.

6. An exercise device comprising a frame having a pair of inclined tracks;

a pair of foot supports, each said foot support being rollably mounted on a respective one of said tracks;

first means coupling said foot supports together to move in opposite directions on said tracks; and second means for dissipating the energy of motion of said foot supports along said tracks.

7. An exercise device as set forth in claim 6 wherein said first means includes a cable means secured to said foot supports and said second means includes a pivotally mounted lever secured to said cable means at an intermediate point thereof and at least one shock absorber secured to said lever to restrain motion of said lever.

8. An exercise device as set forth in claim 7 wherein said shock absorber is secured to said lever at a point approximately 30% as far from a pivot point of said lever as where the point said cable is connected to said lever.

9. An exercise device as set forth in claim 6 wherein each track includes a channel for guiding a respective foot support therein and each foot support includes means for guiding said foot support horizontally within said respective channel.

10. an exercise device as set forth in claim 6 wherein said first means includes a cable means secured to said foot supports.

11. An exercise device as set forth in claim 6 wherein said first means includes a chain secured at opposite ends to said foot supports and said second means includes a sprocket engaging said chain.

12. An exercise device as set forth in claim 11 wherein said second means further includes a rotary actuator connected to said sprocket for rotating in the same direction of rotation of said sprocket.

13. An exercise device as set forth in claim 12 wherein said rotary actuator has an output orifice, an input orifice, a tube having a constriction therein connecting said output orifice to said input orifice, and means for adjusting the size of said constriction.

* * * * *